US010400614B2

(12) United States Patent
Burdgick et al.

(10) Patent No.: US 10,400,614 B2
(45) Date of Patent: Sep. 3, 2019

(54) TURBOMACHINE BUCKET WITH RADIAL SUPPORT, SHIM AND RELATED TURBOMACHINE ROTOR

(71) Applicant: General Electric Company, Schenectady, NY (US)

(72) Inventors: Steven Sebastian Burdgick, Schenectady, NY (US); Thomas Joseph Farineau, Schoharie, NY (US); John James Ligos, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 378 days.

(21) Appl. No.: 15/355,818

(22) Filed: Nov. 18, 2016

(65) Prior Publication Data

US 2018/0142561 A1 May 24, 2018

(51) Int. Cl.
*F01D 5/32* (2006.01)
*F01D 5/02* (2006.01)
(Continued)

(52) U.S. Cl.
CPC ..... *F01D 5/326* (2013.01); *F01D 5/02* (2013.01); *F01D 5/12* (2013.01); *F01D 5/3007* (2013.01);
(Continued)

(58) Field of Classification Search
CPC . F01D 5/326; F01D 5/323; F01D 5/32; F01D 5/02; F01D 5/3007; F01D 5/3023; F01D 5/3053
See application file for complete search history.

(56) References Cited

U.S. PATENT DOCUMENTS 3,556,675 A 1/1971 Howald et al.
4,478,554 A 10/1984 Surdi
(Continued)

FOREIGN PATENT DOCUMENTS

EP 0 110 744 A1 6/1984
EP 0 717 168 A1 6/1996
(Continued)

OTHER PUBLICATIONS

International Search Report and Written Opinion issued in connection with corresponding PCT Application No. PCT/US2017/055349 dated Jan. 30, 2018.
(Continued)

*Primary Examiner* — Jacob M Amick
(74) *Attorney, Agent, or Firm* — Perttu Juhana Henttonen; Hoffman Warnick LLC

(57) ABSTRACT

Various aspects include a turbomachine bucket, corresponding shim and related turbine rotor. In some cases, a steam turbine bucket includes: a blade having a first end, and a second end opposite the first end; a tip at the first end of the blade; and a base at the second end, the base including a dovetail for complementing a corresponding dovetail slot in a steam turbine rotor, the dovetail having: a body; a plurality of projections extending from the body in opposing directions for complementing a plurality of recesses in the corresponding dovetail slot; and a shim locking slot extending through the body along the opposing directions, the shim locking slot being open at a bottom surface of the body and sized to engage a shim.

11 Claims, 13 Drawing Sheets

(51) Int. Cl.
*F01D 5/12* (2006.01)
*F01D 5/30* (2006.01)

(52) U.S. Cl.
CPC ..... *F01D 5/323* (2013.01); *F05D 2220/31* (2013.01); *F05D 2260/30* (2013.01)

(56) References Cited

U.S. PATENT DOCUMENTS

| | | | | |
|---|---|---|---|---|
| 5,236,309 | A * | 8/1993 | Van Heusden | F01D 5/323 416/206 |
| 6,722,850 | B2 | 4/2004 | Burdgick | |
| 6,832,892 | B2 | 12/2004 | Murphy et al. | |
| 2004/0239040 | A1 | 12/2004 | Burdgick | |
| 2011/0014053 | A1 | 1/2011 | Eastman et al. | |

FOREIGN PATENT DOCUMENTS

| | | | |
|---|---|---|---|
| EP | 2 439 378 | A2 | 4/2012 |
| EP | 2 642 077 | A1 | 9/2013 |
| GB | 2 038 959 | A | 7/1980 |

OTHER PUBLICATIONS

Burdgick, S.S., et al., Margin Bucket Dovetail Radial Support Feature for Axial Entry Buckets, GE U.S. Appl. No. 62/342,355, filed May 27, 2016.

* cited by examiner

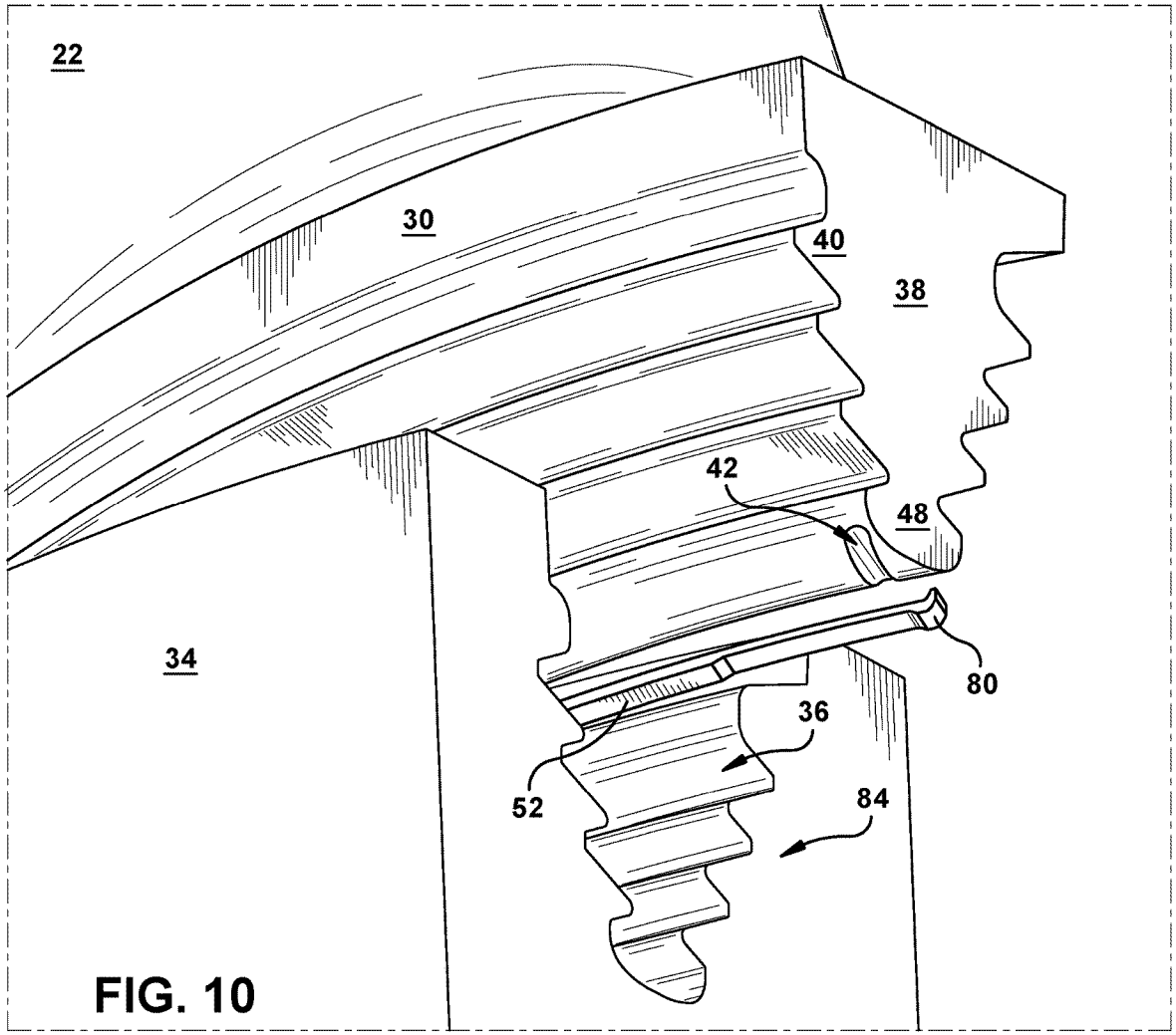
FIG. 10
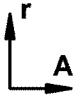

TURBOMACHINE BUCKET WITH RADIAL SUPPORT, SHIM AND RELATED TURBOMACHINE ROTOR

FIELD OF THE INVENTION

The subject matter disclosed herein relates to turbomachines. Specifically, the subject matter disclosed herein relates to support of buckets in turbomachines, e.g., steam turbines.

BACKGROUND OF THE INVENTION

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Buckets, such as those in the last stage of the turbine, have a base with a dovetail that are sized to fit within corresponding dovetail slots in the rotor. Many last stage buckets are of significant length and have a substantial weight. During low speed (also known as, turning gear) operation, the buckets have the ability to move within the rotor dovetails where they are retained. This undesirable movement can cause significant wear on the bucket and/or rotor dovetail slots. This wear on the buckets and dovetail slots can cause outages, require repairs, and incur undesirable costs.

BRIEF DESCRIPTION OF THE INVENTION

Various aspects include a turbomachine bucket, corresponding shim and related turbine rotor. In a first aspect of the disclosure, a steam turbine bucket includes: a blade having a first end, and a second end opposite the first end; a tip at the first end of the blade; and a base at the second end, the base including a dovetail for complementing a corresponding dovetail slot in a steam turbine rotor, the dovetail having: a body; a plurality of projections extending from the body in opposing directions for complementing a plurality of recesses in the corresponding dovetail slot; and a shim locking slot extending through the body along the opposing directions, the shim locking slot being open at a bottom surface of the body and sized to engage a shim.

A second aspect of the disclosure includes a shim for retaining a steam turbine bucket, the shim including: a main body having a first thickness measured between an upper surface and a lower surface; a thinned region extending from the main body and having a second thickness measured between the upper surface and a thinned, lower surface; a first tapered region connecting the main body and the thinned region; a locking region extending from the thinned region and including a hook, the hook extending from the upper surface and sized to engage a shim locking slot in the steam turbine bucket; and a second tapered region connecting the thinned region and the locking region.

A third aspect of the disclosure includes a steam turbine rotor having: a rotor body having a plurality of dovetail slots including a plurality of recesses; a steam turbine bucket within one of the plurality of dovetail slots, the steam turbine bucket having: a blade having a first end, and a second end opposite the first end; a tip at the first end of the blade; and a base at the second end, the base including a dovetail complementing the dovetail slot in the steam turbine rotor, the dovetail having: a body; a plurality of projections extending from the body in opposing directions complementing the plurality of recesses in the dovetail slot; and a shim locking slot extending through the body along the opposing directions, the shim locking slot being open at a bottom surface of the body.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which:

FIG. 10 shows a blow-out schematic perspective view of a steam turbine bucket, a rotor, and a shim according to various embodiments of the disclosure.

Figure 1:
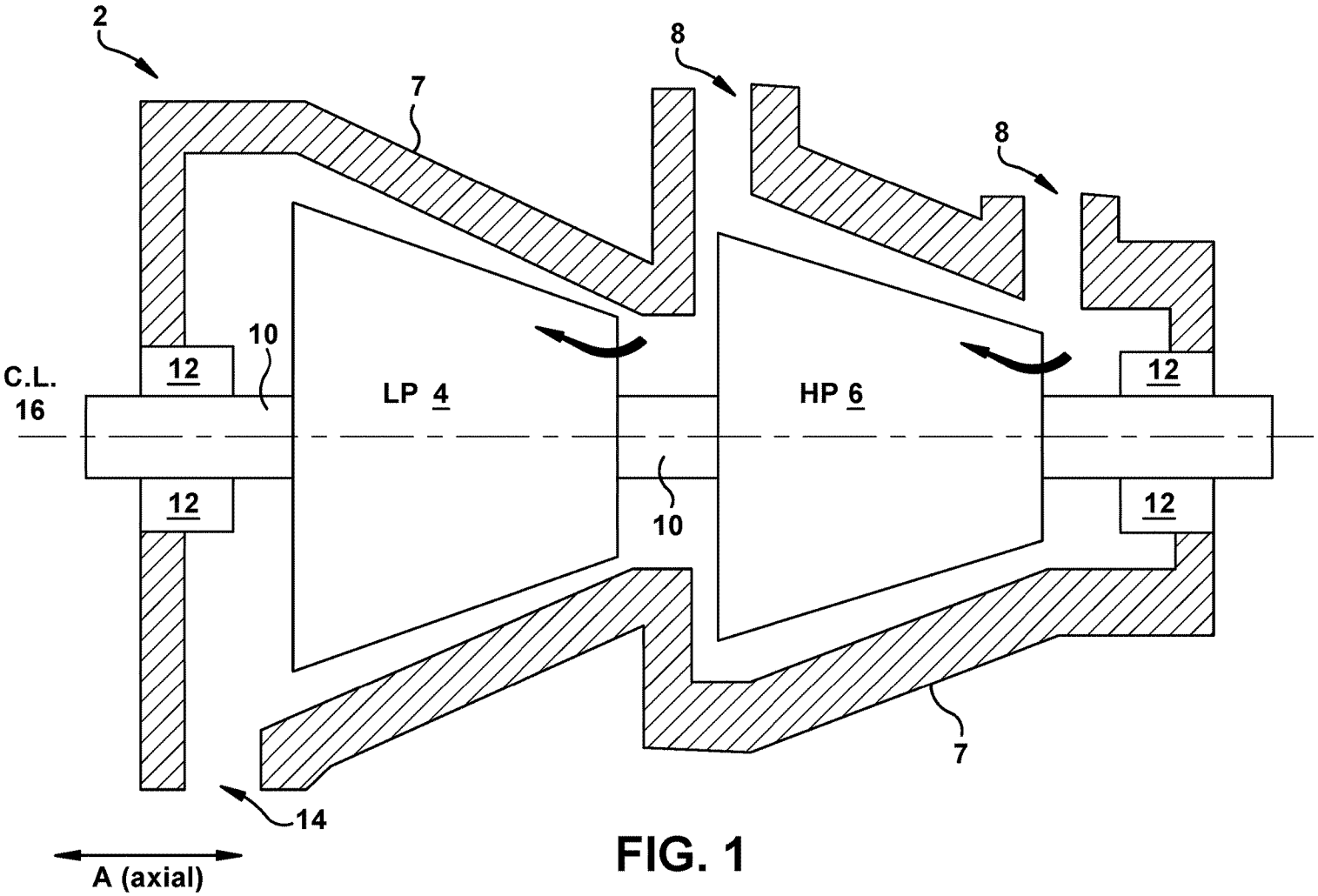
FIG. 1 shows a partial cross-sectional schematic view of a turbomachine according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates to turbomachines. Specifically, the subject matter disclosed herein relates to supporting buckets in turbomachines, e.g., steam turbines.

As denoted in these Figures, the "A" axis represents axial orientation (along the axis of the turbine rotor, sometimes referred to as the turbine centerline). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location. Identically labeled elements in the Figures depict substantially similar (e.g., identical) components.

In contrast to conventional components and approaches for retaining buckets in steam turbines, various aspects of the disclosure provide for a steam turbine bucket, and a corresponding retaining shim, which enhance the ease of installation and/or removal of buckets from steam turbine rotors, as well as improve the retention of those buckets within the rotor. Conventional systems for retaining buckets within rotors utilize combinations of wedges, springs and tight-fitting dovetail connections. These systems can occupy a significant amount of space, be difficult to install, and/or cause stresses on components such as the bucket dovetail or rotor dovetail due to their tight fit and limited flexibility. The components disclosed according to various embodiments described herein can be installed with much less effort than conventional configurations, and provide for enhanced retention during operation.

Turning to FIG. 1, a partial cross-sectional schematic view of steam turbine 2 (e.g., a high-pressure/intermediate-pressure steam turbine) is shown. Steam turbine 2 may include, for example, a low pressure (LP) section 4 and a high pressure (HP) section 6 (it is understood that either LP section 4 or HP section 6 can include an intermediate pressure (IP) section, as is known in the art). The LP section 4 and HP section 6 are at least partially encased in casing 7. Steam may enter the HP section 6 and LP section 4 via one or more inlets 8 in casing 7, and flow axially downstream from the inlet(s) 8. In some embodiments, HP section 6 and LP section 4 are joined by a common shaft 10, which may contact bearings 12, allowing for rotation of shaft 10, as working fluid (steam) forces rotation of the blades within each of LP section 4 and HP section 6. After performing mechanical work on the blades within LP section 4 and HP section 6, working fluid (e.g., steam) may exit through outlet 14 in casing 7. The center line (CL) 16 of HP section 6 and LP section 4 is shown as a reference point. Both LP section 4 and HP section 6 can include diaphragm assemblies, which are contained within segments of casing 7.

Figure 2:
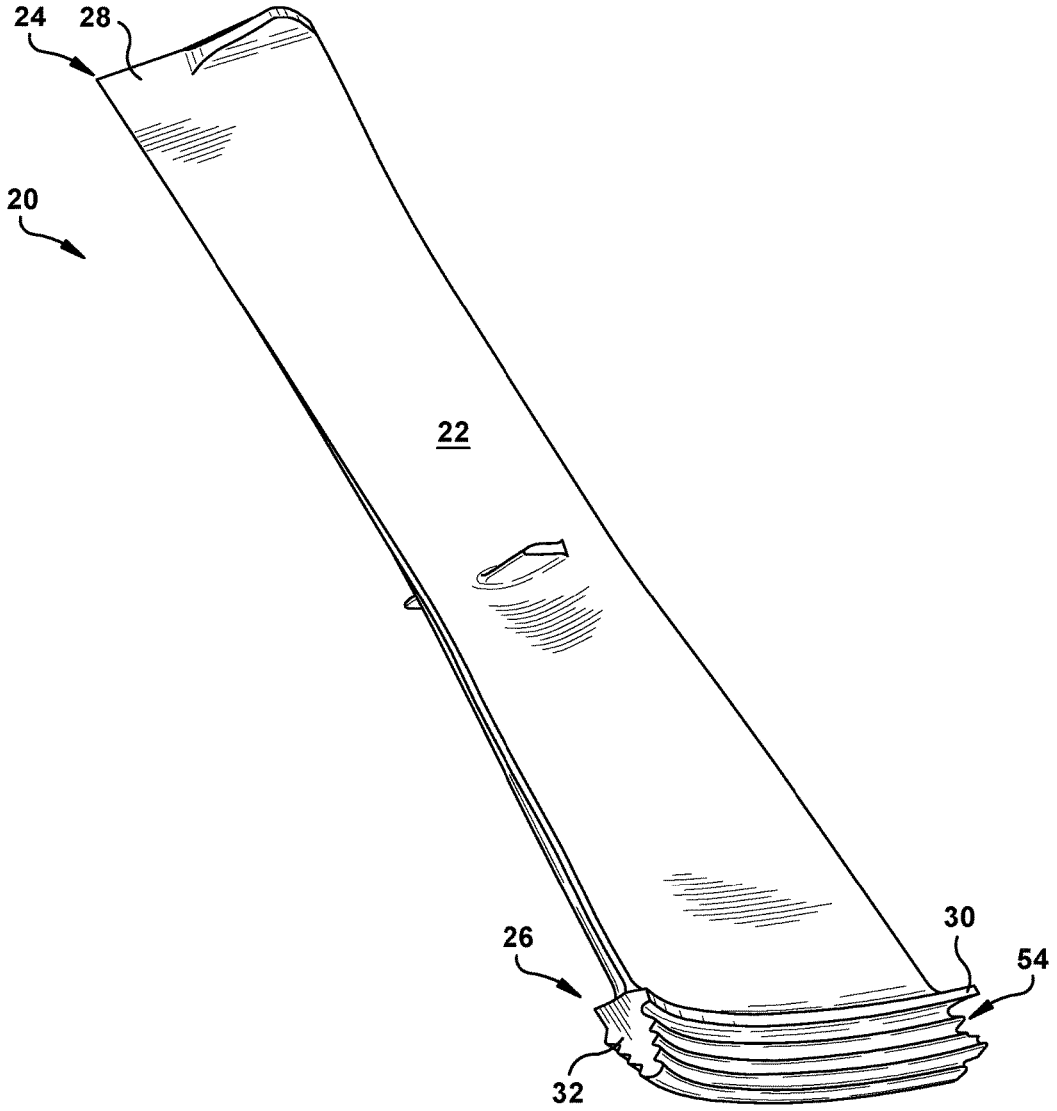
FIG. 2 shows a schematic perspective view of a steam turbine bucket according to various embodiments of the disclosure.
Figure 3:
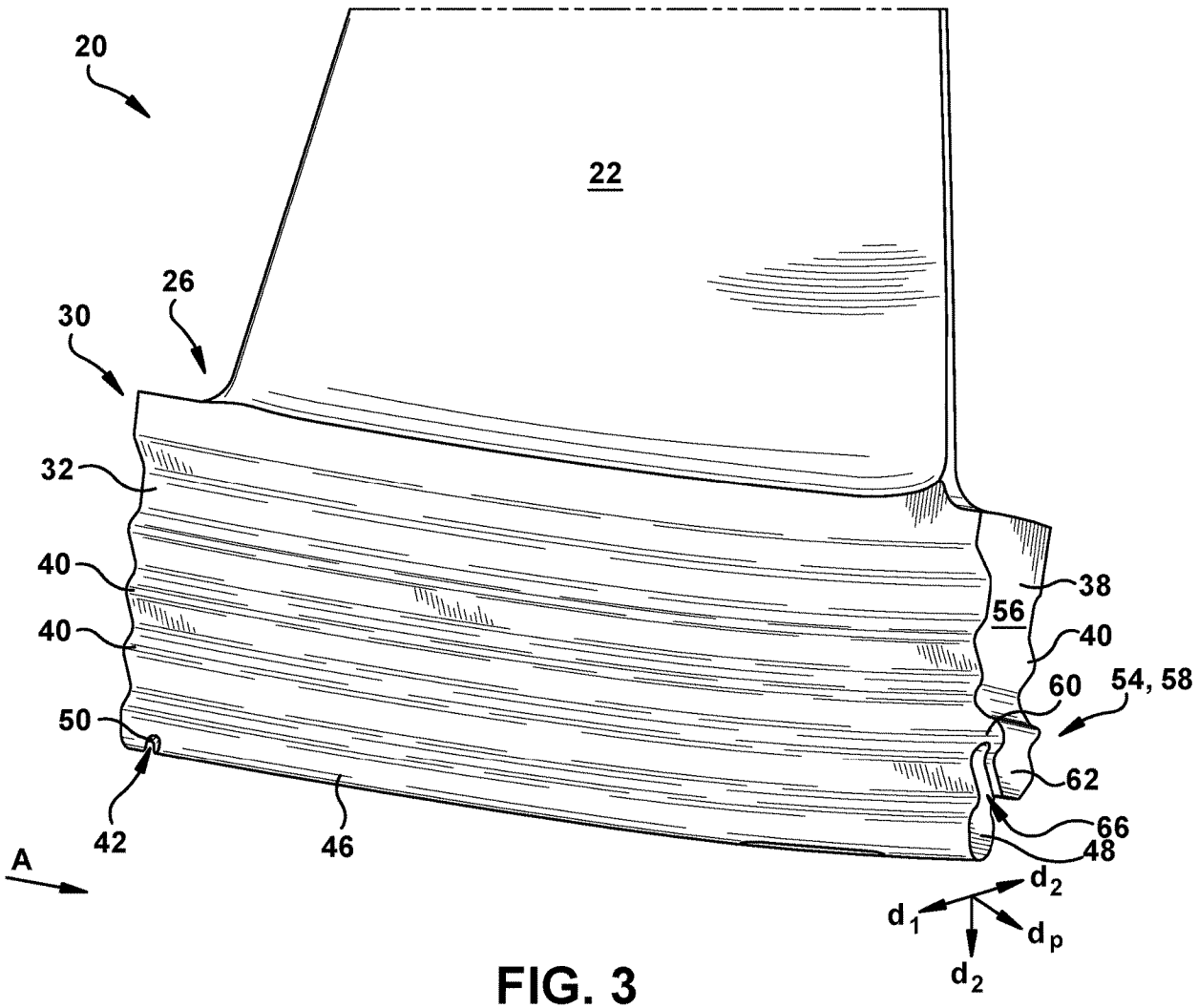
FIG. 3 shows a close-up view of the steam turbine bucket of FIG. 2.
Figure 4:
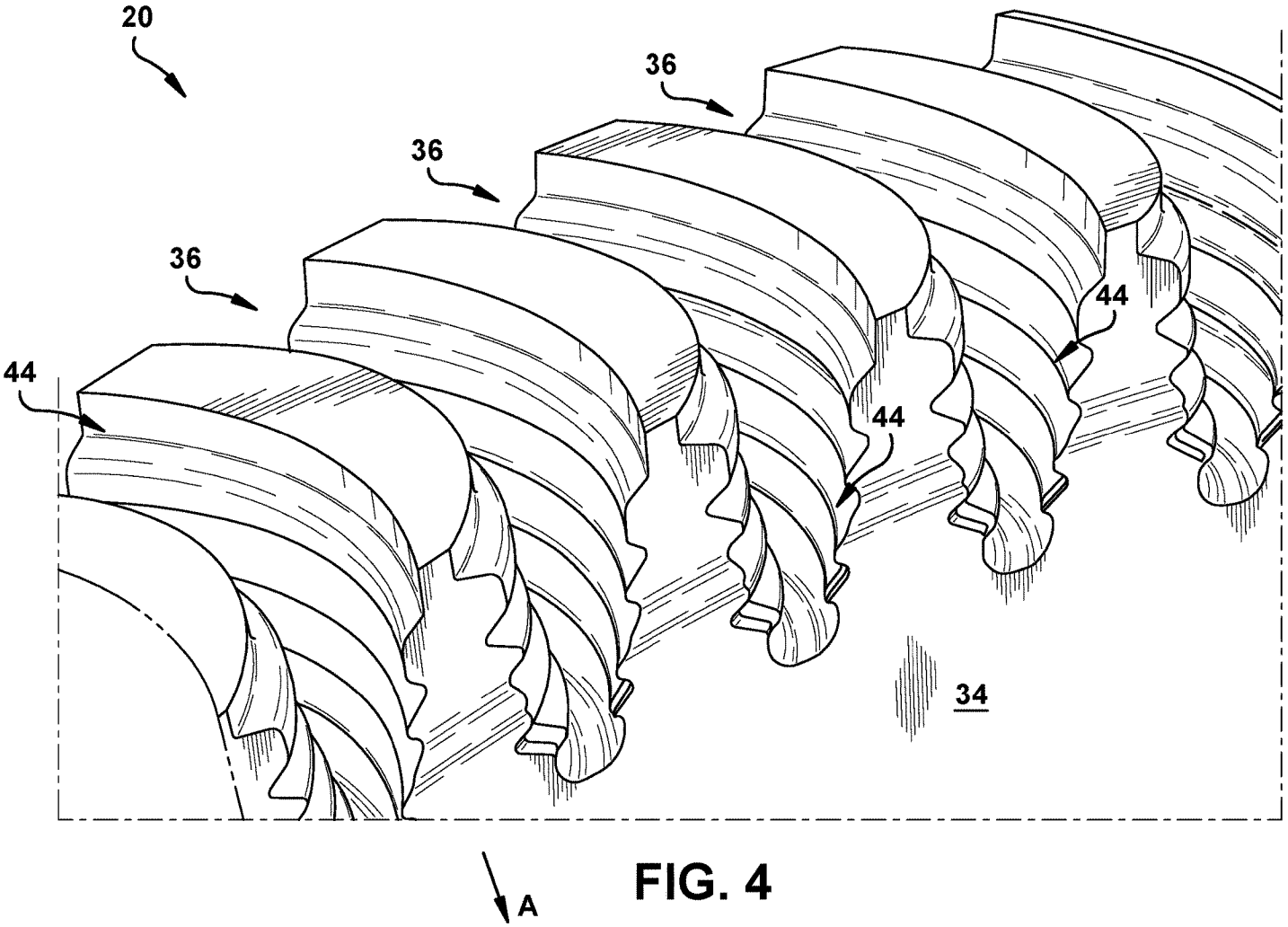
FIG. 4 shows a close-up schematic perspective view of a steam turbine rotor.

FIG. 2 shows a schematic perspective view of a steam turbine bucket 20 (e.g., within HP section 6 and/or LP section 4) according to various embodiments of the disclosure. FIG. 3 shows a close-up perspective view of a portion of the steam turbine bucket 20. As shown, steam turbine bucket (or simply, bucket) 20 can include a blade 22 having a first end 24, and a second end 26 opposite first end 24. First end 24 of blade 22 can include a tip 28, which may be coupled to a shroud (not shown) in some embodiments. At second end 26 of blade 22 is a base 30, which includes a dovetail 32 for complementing a corresponding dovetail slot in a rotor (FIG. 4). FIG. 4 shows a close-up perspective view of a portion of a rotor 34 (e.g., a steam turbine rotor) including a set of dovetail slots 36 for coupling with dovetail 32 of bucket 20.

Figure 5:
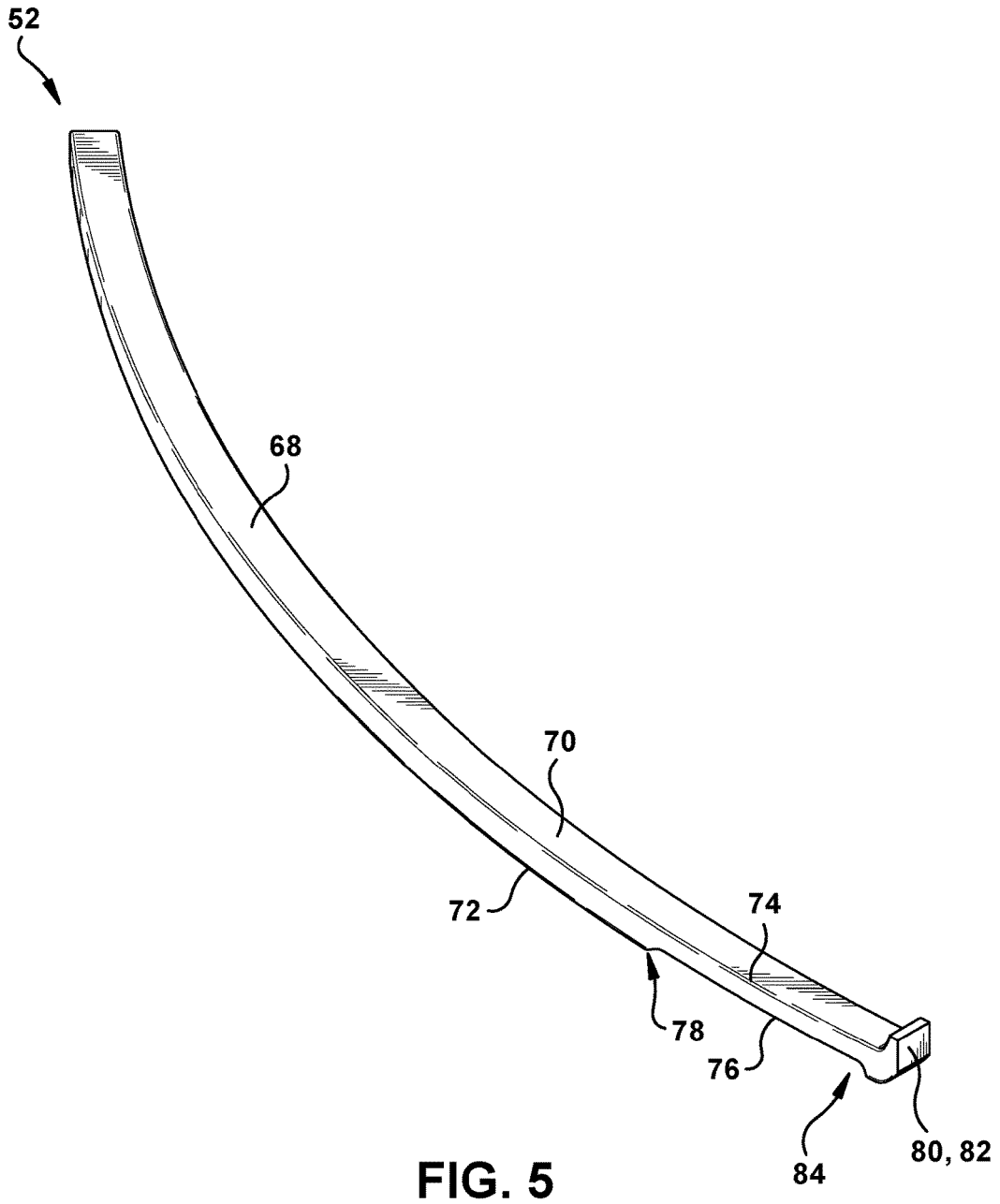
FIG. 5 shows a schematic perspective view of a shim according to various embodiments of the disclosure.
Figure 6:
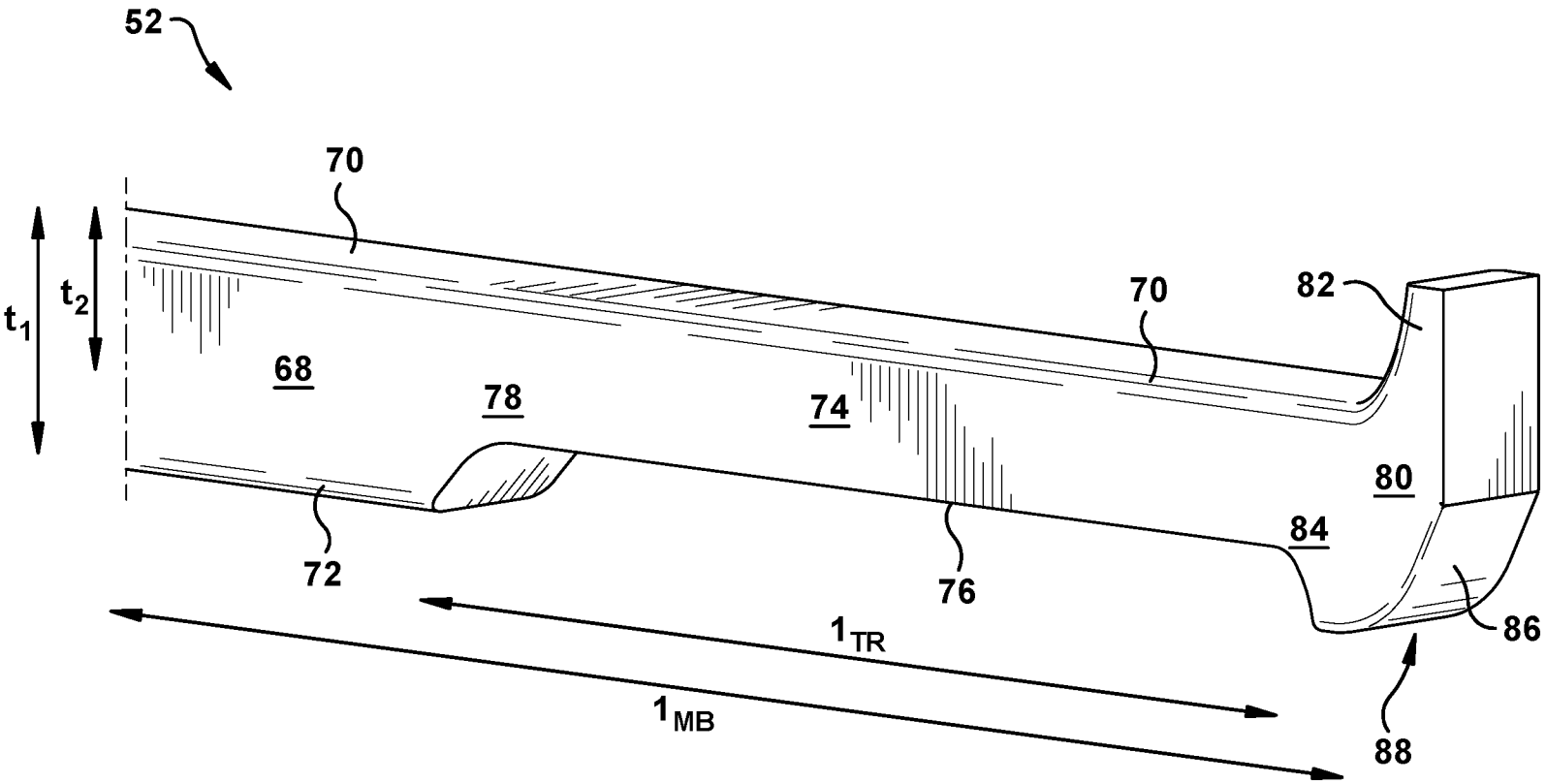
FIG. 6 shows a close-up view of the shim of FIG. 5.

Returning to FIG. 3, in contrast to conventional steam turbine buckets, bucket 20 can include dovetail 32, which includes: a body 38, a plurality of projections 40 extending from the body in opposing directions ($d_1$, $d_2$), and a shim locking slot 42 extending through body 38 along the opposing directions ($d_1$, $d_2$). The plurality of projections 40 are sized to complement a plurality of recesses 44 in the corresponding dovetail slot 36 (FIG. 4). In various embodiments, shim locking slot 42 is open at a bottom surface 46 of body 38, and is sized to engage a shim (FIG. 5). In some cases, shim locking slot 42 can extend entirely through body 38 along the opposing directions ($d_1$, $d_2$). However, it is understood that shim locking slot 42 can take various forms in order to engage a shim (FIG. 5). In various embodiments, body 38 includes a lowermost bulbous section 48 for complementing one of the plurality of recesses 44 in dovetail slot 36 (FIG. 4). In some cases, shim locking slot 42 extends from bottom surface 46 of body 38 to a location 50 within lowermost bulbous section 48. A shim 52 is shown schematically in FIG. 5, and in a close-up perspective in FIG. 6, and further described herein.

Figure 7:
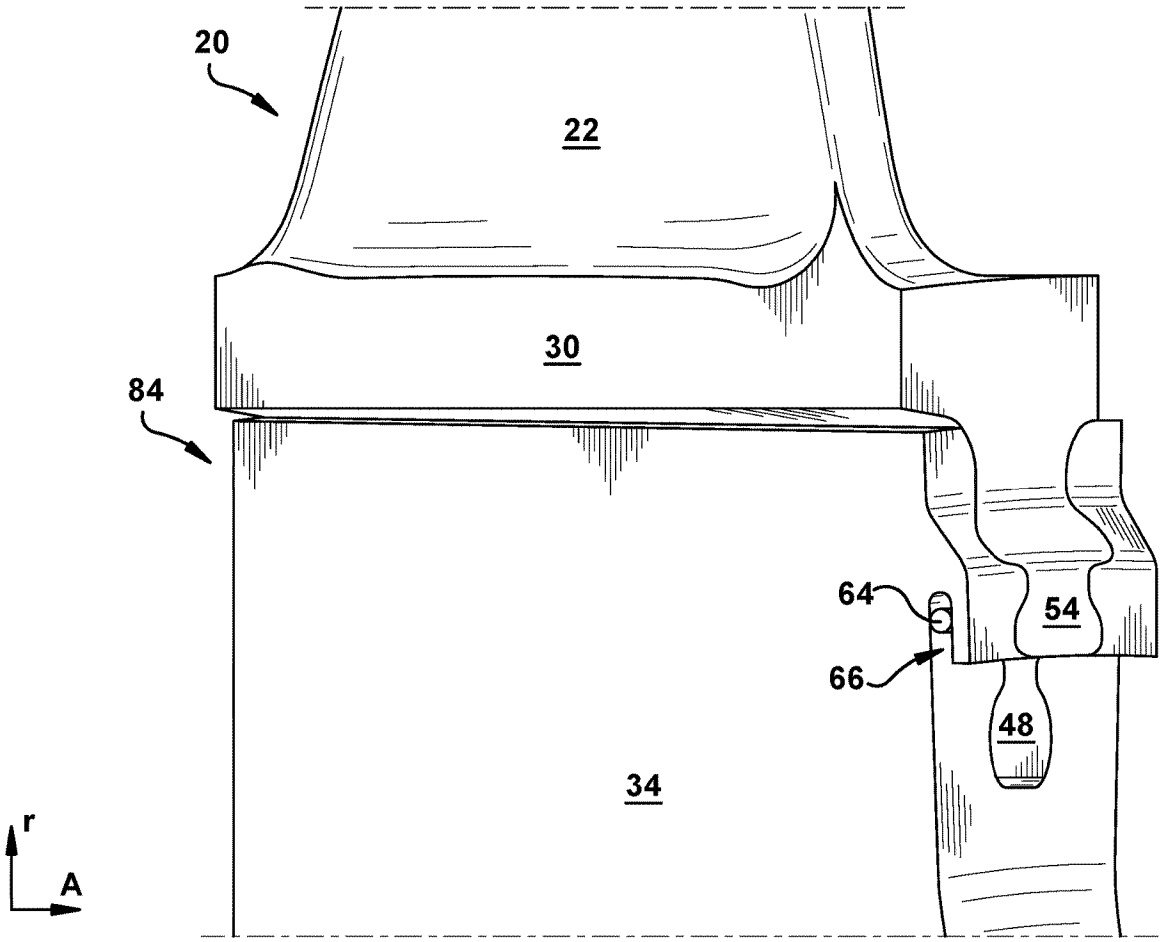
FIG. 7 shows a schematic perspective view of a portion of a steam turbine bucket, rotor and retaining member according to various embodiments of the disclosure.
Figure 8:
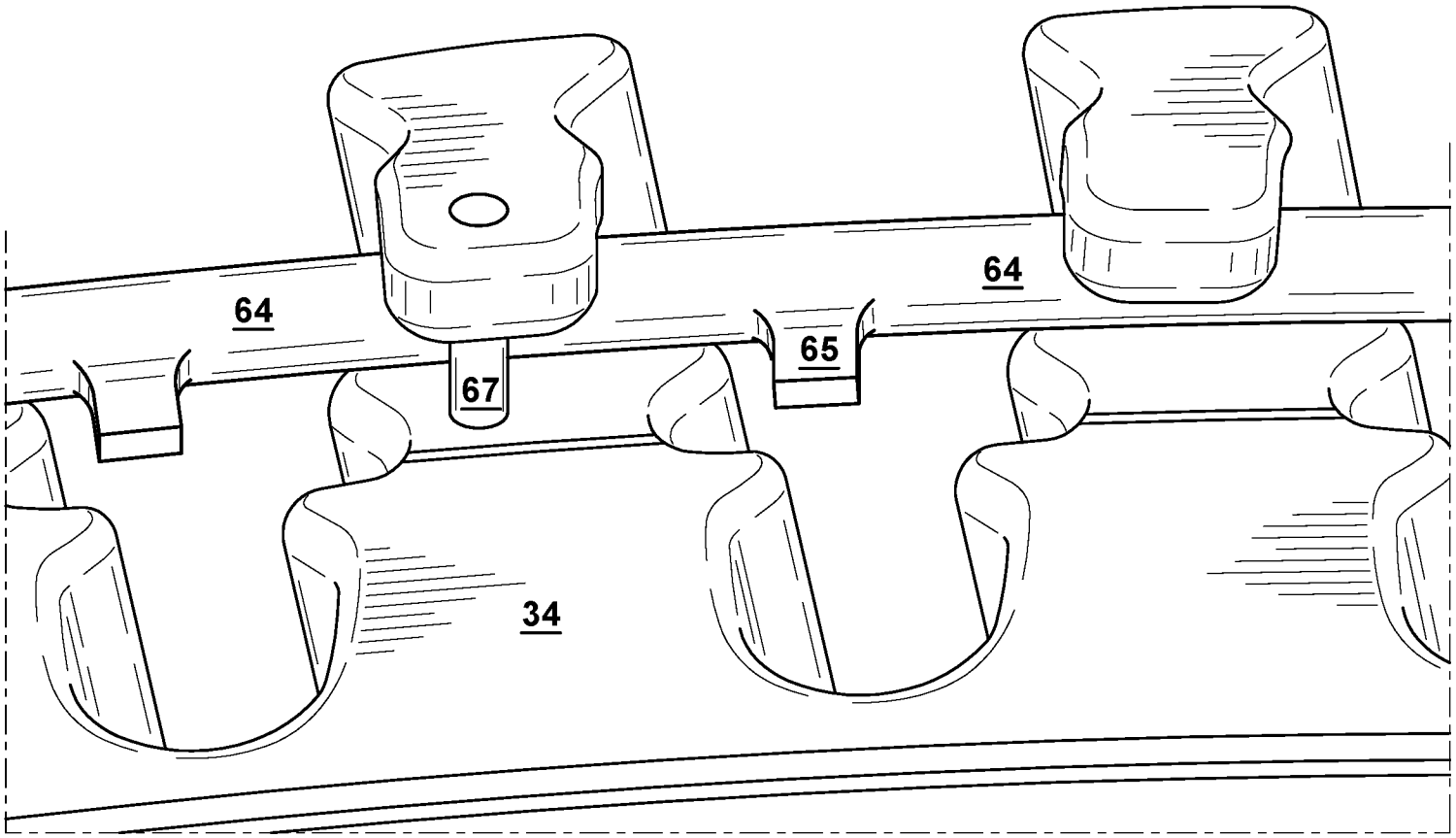
FIG. 8 shows a schematic perspective view of a steam turbine rotor and retaining member according to various embodiments of the disclosure.

Returning to FIG. 3, according to various embodiments, bucket 20 can further include an axial retention feature 54 extending from a side 56 of body 38 in a direction ($d_p$) perpendicular from the plurality of projections 40. That is, axial retention feature 54 can extend from side 56 of body 38 in direction ($d_p$) that is perpendicular to the opposing directions ($d_1$, $d_2$). In some cases, axial retention feature 54 can include a hook 58, having a first member 60 extending from body 38 in a first direction (direction $d_p$), and a second member 62 extending from first member 60 in a second, distinct direction ($d_{h2}$). In various embodiments, second, distinct direction ($d_{h2}$) is perpendicular to first direction ($d_p$). As described further herein, axial retention feature 54 is configured to aid in axially retaining bucket 20 in rotor 34 (in axial direction, A), via an axial retention member 64 (FIG. 7, FIG. 8). In various embodiments, axial retention feature 54 defines a space 66 adjacent body 38 that is sized to engage the axial retention member 64. Space 66 may be located between axial retention feature 54 and side 56 of body 38 in some embodiments. FIG. 7 shows a schematic cut-away depiction of bucket 20 engaged with rotor 34, and portion of an axial retention member 64 within space 66 for axially retaining bucket 20 within rotor 34. FIG. 8 shows a perspective radially outwardly facing view of axial retention member 64 positioned relative to rotor 34, excluding bucket(s) 20. In some cases, axial retention member 64 further includes an anti-rotation tab 65 (FIG. 8) for engaging hook 58 (FIG. 3) and preventing rotation of axial retention member 64 within space 66 (FIG. 3, FIG. 7). Additionally, an anti-rotation pin 67 (FIG. 8) can be coupled to rotor 34 to prevent radial movement of axial retention member 64 within space 66.

Returning to FIG. 5 and FIG. 6, shim 52 is shown in greater detail. In various embodiments, shim 52 is sized to engage shim locking slot 42 in bucket 20 and help to retain bucket 20 within dovetail slot 36 (FIG. 4). In some cases, shim 52 includes a main body 68 having a first thickness ($t_1$) measured between an upper surface 70 and a lower surface 72 of main body 68 (where upper and lower surfaces 70, 72 coincide with radially inner and radially outer surfaces, respectively, when shim 52 is loaded between bucket and rotor 34 in dovetail slot 36). Extending from main body 68 is a thinned region 74, having a second thickness ($t_2$) measured between upper surface 70 (which is continuous between main body 68 and thinned region 74) and a thinned, lower surface 76. In some cases, the second thickness ($t_2$) is between approximately (e.g., +/−1-5%) 5 percent to approximately 50 percent of the first thickness ($t_1$). Connecting main body 68 and thinned region 74 is a first tapered region 78, which is tapered inward from main body 68 to thinned region 74. Shim 52 can further include a locking region 80 extending from thinned region 74. Locking region 80 can include a hook 82, which can extend away from upper surface 70 (e.g., radially inward). Hook 82 can be sized to engage shim locking slot 42 (FIG. 3) in bucket 20. Shim 52 may further include a second tapered region 84 connecting thinned region 74 and locking region 80, which is tapered inward from locking region 80 to thinned region 74. In various embodiments, locking region 80 can have an equal thickness ($t_1$) (excluding hook 82) as main body 68, which can help prevent hook 82 from disengaging with shim locking slot 42 once bucket 20 is loaded into dovetail slot 36.

As described herein, shim 52 is configured to fit between dovetail 32 of bucket 20, and dovetail slot 36 of rotor 34, and aid in retaining bucket 20 within rotor 34. In some cases, hook 82 can aid in engaging bucket 20, via interaction with complementary shim locking slot 42. Further, in various embodiments, thinned region 74 enhances ease of installation and removal of shim 52 within the tight clearances of the steam turbine. That is, thinned region 74 can permit flexion of shim 52 within a slot 84 proximate bucket 20 (shown in FIG. 7 and FIG. 10). In some cases, locking region 80 includes a rounded edge 86 along its lower surface 88 (FIG. 6), which may allow the shim 52 to be inserted (e.g., locking region 80 first), and flexed to engage shim locking slot 42. It is understood that shim 52 can be inserted in either a forward or aft direction into slot 84, depending upon clearances and desired installation techniques. In various embodiments, thinned region 74 can have a length ($l_{TR}$) equal to approximately one-quarter of a length ($l_{MB}$) of main body 68.

Figure 9:
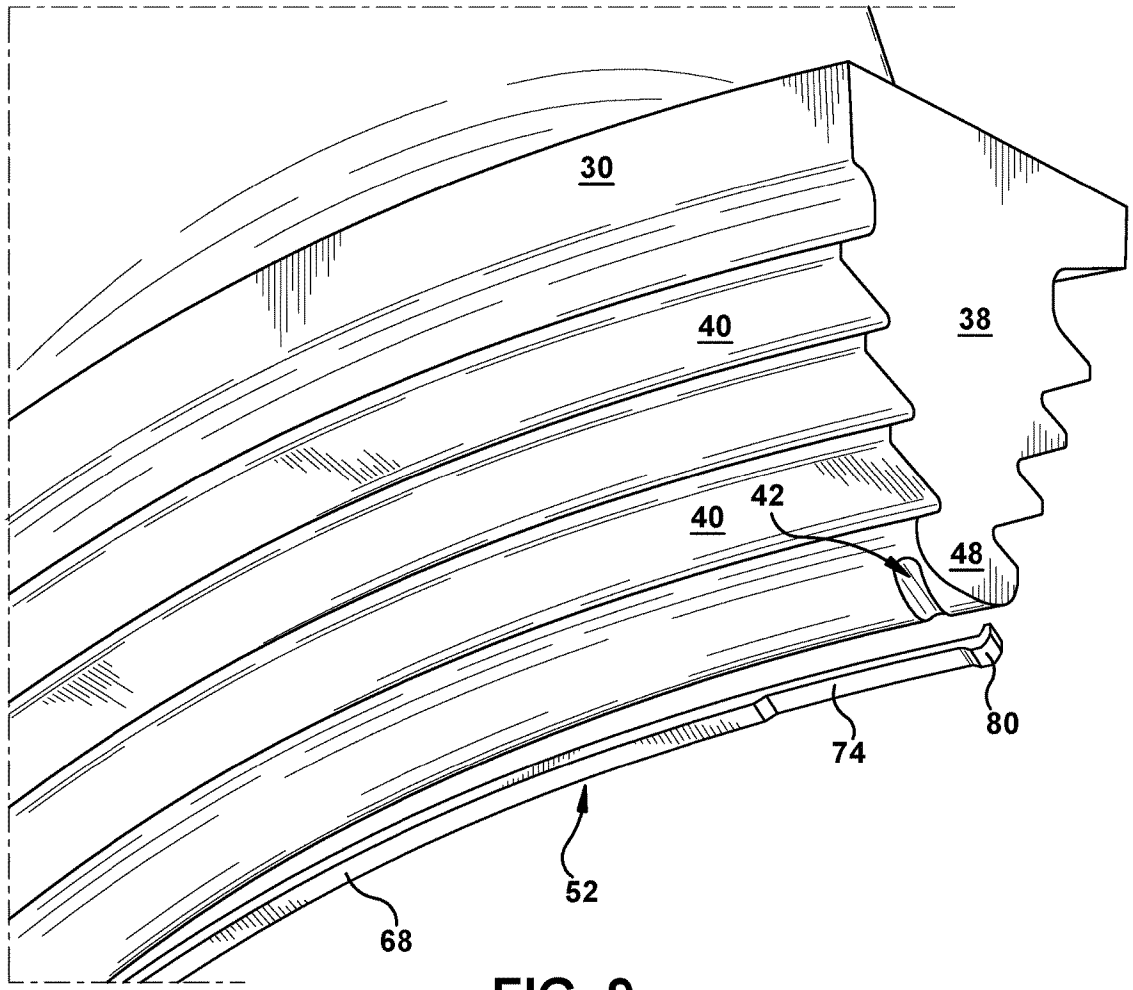
FIG. 9 shows a blow-out schematic perspective view of a steam turbine bucket and a shim according to various embodiments of the disclosure.

FIGS. 9 and 10 illustrate perspective blown-out views of bucket 20, rotor 34 (FIG. 10), and shim 52. FIG. 4 also shows a section of rotor 34 including a plurality of dovetail slots 36, as noted herein. In various aspects of the disclosure, a rotor 34 includes the plurality of dovetail slots 36, and at least one bucket 20 within one of the plurality of dovetail slots 36. In some cases, an entire stage of a rotor 34 is assembled using bucket(s) 20, or multiple stages of rotor 34 are assembled using bucket(s) 20. As can be seen in FIGS. 9 and 10, locking region 80 is sized to complement shim locking slot 42, and fit between dovetail 32 of bucket 20 and dovetail slot 36 of rotor 34.

Figure 11:
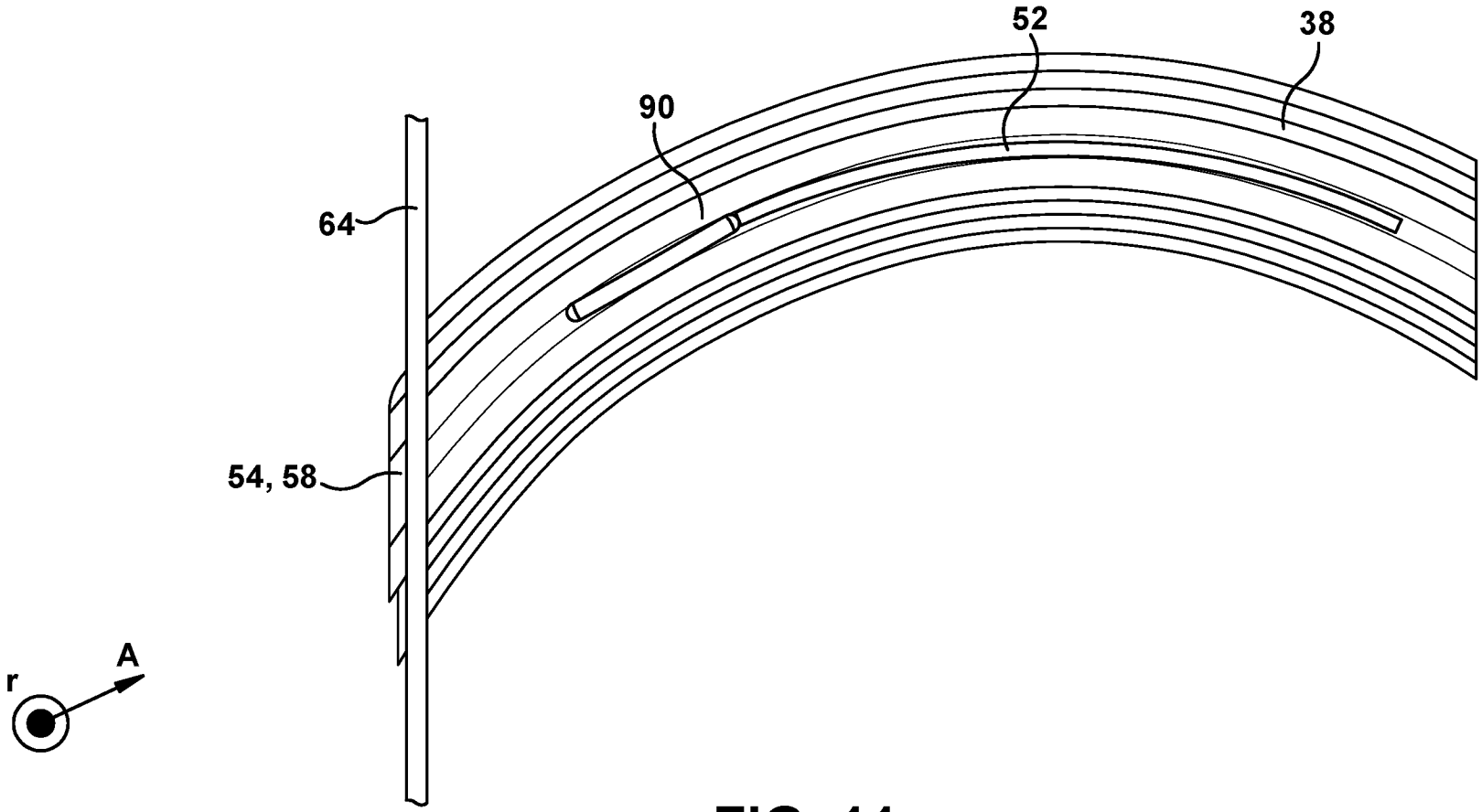
FIG. 11 shows a cut-away view of a steam turbine bucket from the perspective of a rotor according to various embodiments of the disclosure.
Figure 12:
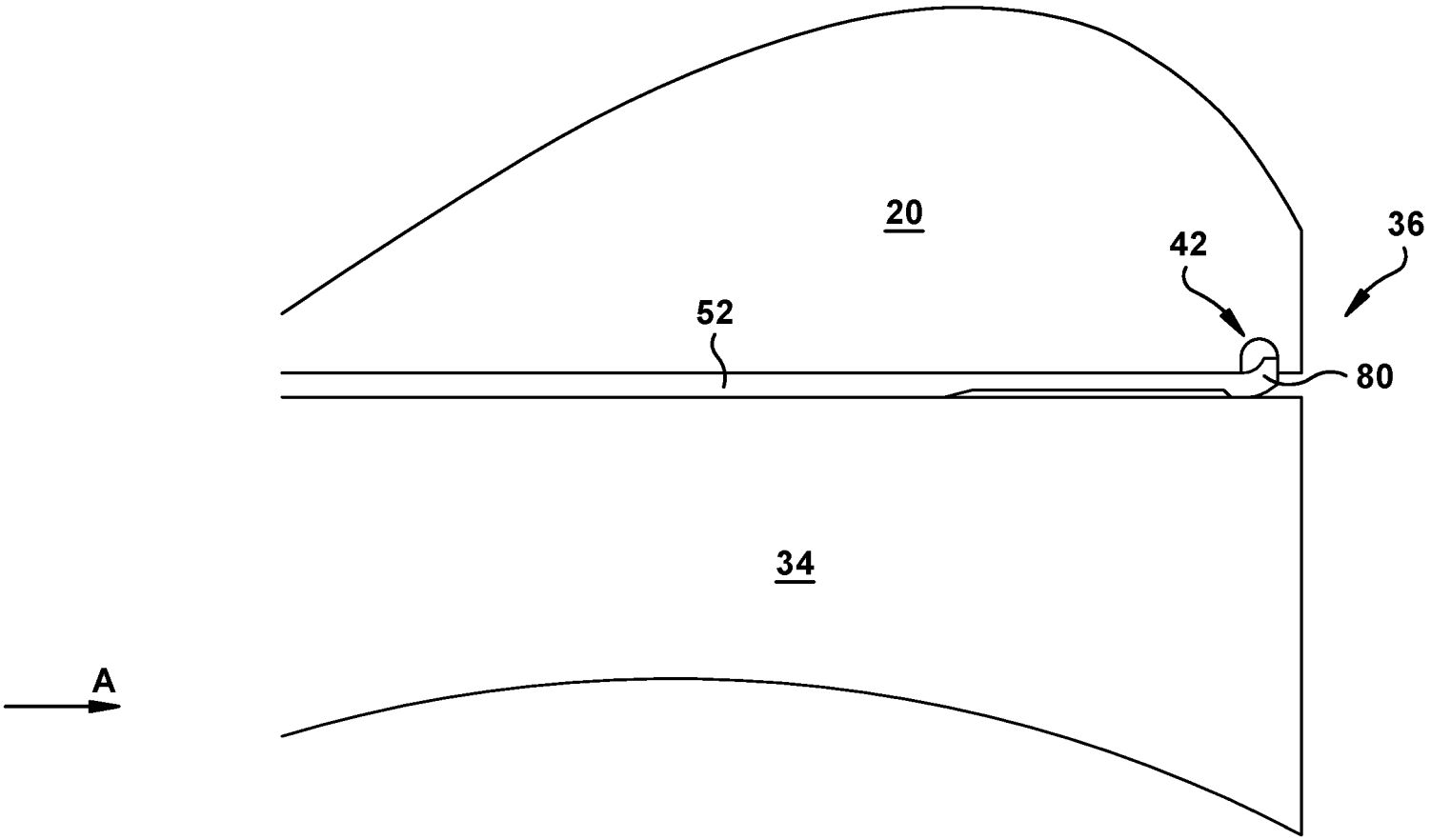
FIG. 12 illustrates a cross-sectional view through an assembled portion of a steam turbine rotor, illustrating the relationship between a bucket, a rotor, and a shim within a dovetail slot, according to various embodiments of the disclosure.

FIG. 11 shows a cut-away view of bucket 20 from the perspective of rotor 34, illustrating an additional feature according to various embodiments. As shown, a spring 90 may be loaded into dovetail slot 36 after placement of shim 54 to axially retain shim 54 within slot 36. Spring 90 can be loaded in the substantially axial direction (A) to further maintain the position of shim 52 relative to bucket 20. FIG. 12 illustrates a cross-section through an assembled portion of rotor 34, illustrating the relationship between bucket 20, rotor 34, and shim 52 within dovetail slot 36.

Bucket 20 and/or shim 52 (FIGS. 2-12) may be formed in a number of ways. In one embodiment, bucket 20 and/or shim 52 (FIGS. 2-12) may be formed by casting, forging, welding and/or machining. In one embodiment, however, additive manufacturing is particularly suited for manufacturing bucket 20 and/or shim 52 (FIGS. 2-12). As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic, much of which is cut away and discarded, the only material used in additive manufacturing is what is required to shape the part. Additive manufacturing processes may include but are not limited to: 3D printing, rapid prototyping (RP), direct digital manufacturing (DDM), selective laser melting (SLM) and direct metal laser melting (DMLM). In the current setting, DMLM has been found advantageous.

Figure 13:
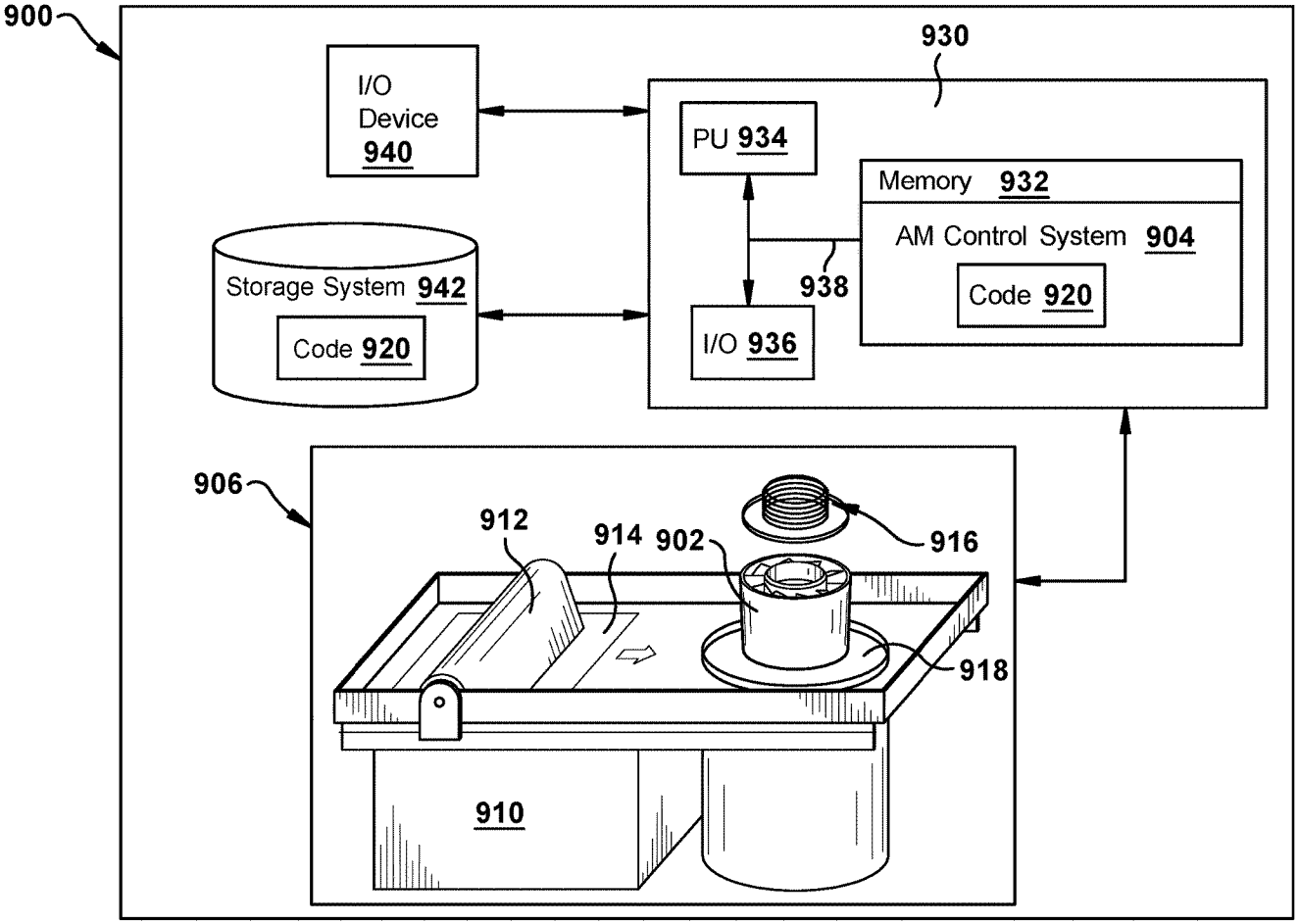
FIG. 13 shows a block diagram of an additive manufacturing process including a non-transitory computer readable storage medium storing code representative of a shim and/or a steam turbine bucket according to embodiments of the disclosure.

To illustrate an example of an additive manufacturing process, FIG. 13 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as a double walled turbine element; however, it is understood that the additive manufacturing process can be readily adapted to manufacture bucket 20 and/or shim 52 (FIGS. 2-12). AM system 900 generally includes a computerized additive manufacturing (AM) control system 904 and an AM printer 906. AM system 900, as will be described, executes code 920 that includes a set of computer-executable instructions defining bucket 20 and/or shim 52 (FIGS. 2-12) to physically generate the object using AM printer 906. Each AM process may use different raw materials in the form of, for example, fine-grain powder, liquid (e.g., polymers), sheet, etc., a stock of which may be held in a chamber 910 of AM printer 906. In the instant case, bucket 20 and/or shim 52 (FIGS. 2-12) may be made of plastic/polymers or similar materials. As illustrated, an applicator 912 may create a thin layer of raw material 914 spread out as the blank canvas from which each successive slice of the final object will be created. In other cases, applicator 912 may directly apply or print the next layer onto a previous layer as defined by code 920, e.g., where the material is a polymer. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of bucket 20 and/or shim 52 (FIGS. 2-12), described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of bucket 20 and/or shim 52 (FIGS. 2-12). As noted, code 920 includes a set of computer-executable instructions defining outer electrode that can be used to physically generate the tip, upon execution of the code by system 900. For example, code 920 may include a precisely defined 3D model of outer electrode and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing bucket 20 and/or shim 54 (FIGS. 2-12) into a series of thin slices that it assembles using AM printer 906 in successive layers of liquid, powder, sheet or other material. In the DMLM example, each layer is melted to the exact geometry defined by code 920 and fused to the preceding layer. Subsequently, the bucket 20 and/or shim 52 (FIGS. 2-12) may be exposed to any variety of finishing processes, e.g., minor machining, sealing, polishing, assembly to other part of the igniter tip, etc.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., soldering, fastening, ultrasonic welding, bonding). In various embodiments, electronic components described as being "coupled" can be linked via conventional hard-wired and/or wireless means such that these electronic components can communicate data with one another.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine bucket comprising:

a blade having a first end, and a second end opposite the first end;

a tip at the first end of the blade; and a base at the second end, the base including a dovetail for complementing a corresponding dovetail slot in a steam turbine rotor, the dovetail having:

a body;

a plurality of projections extending from the body in opposing directions for complementing a plurality of recesses in the corresponding dovetail slot;

a shim locking slot extending through the body along the opposing directions, the shim locking slot being open at a bottom surface of the body and sized to engage a shim; and an axial retention feature extending from a side of the body in a direction perpendicular from the plurality of projections, wherein the axial retention feature includes a hook defining a space adjacent the body, the space sized to engage an axial retention member, wherein the axial retention member further includes an anti-rotation tab for engaging the hook of the axial retention feature.

2. The steam turbine bucket of claim 1, wherein the hook includes a first member extending from the body in a first direction and a second member extending from the first member in a second, distinct direction.

3. The steam turbine bucket of claim 1, wherein the body includes a lowermost bulbous section for complementing one of the plurality of recesses, and wherein the shim locking slot extends from the bottom surface of the body to a location within the lowermost bulbous section.

4. A steam turbine rotor comprising:

a rotor body having a plurality of dovetail slots including a plurality of recesses;

a steam turbine bucket within one of the plurality of dovetail slots, the steam turbine bucket having:

a blade having a first end, and a second end opposite the first end;

a tip at the first end of the blade;

a base at the second end, the base including a dovetail complementing the dovetail slot in the steam turbine rotor, the dovetail having:

a body;

a plurality of projections extending from the body in opposing directions complementing the plurality of recesses in the dovetail slot;

a shim locking slot extending through the body along the opposing directions, the shim locking slot being open at a bottom surface of the body; and an axial retention feature extending from a side of the body in a direction perpendicular from the plurality of projections, wherein the axial retention feature includes a hook defining a space adjacent the body; and an axial retention member in the space adjacent the body, wherein the axial retention member further includes an anti-rotation tab for engaging the hook of the axial retention feature.

5. The steam turbine rotor of claim 4, further comprising a shim for retaining the steam turbine bucket in the dovetail slot.

6. The steam turbine rotor of claim 5, wherein the shim includes:

a main body having a first thickness measured between an upper surface and a lower surface;

a thinned region extending from the main body and having a second thickness measured between the upper surface and a thinned, lower surface;

a first tapered region connecting the main body and the thinned region;

a locking region extending from the thinned region and including a hook, the hook extending from the upper surface and sized to complement the shim locking slot in the steam turbine bucket; and a second tapered region connecting the thinned region and the locking region.

7. The steam turbine rotor of claim 6, wherein the body of the steam turbine bucket includes a lowermost bulbous section complementing a lowermost one of the plurality of recesses, and wherein the shim locking slot extends from the bottom surface of the body to a location within the lowermost bulbous section.

8. The steam turbine rotor of claim 7, wherein the thinned region of the shim permits flexion of the shim within the lowermost one of the recesses.

9. The steam turbine rotor of claim 8, wherein the locking region further includes a rounded edge along a lower surface thereof.

10. The steam turbine bucket of claim 1, wherein the steam turbine rotor is coupled with an anti-rotation pin to prevent radial movement of the axial retention member within the space adjacent the body.

11. The steam turbine rotor of claim 4, further comprising an anti-rotation pin coupled to the rotor to prevent radial movement of the axial retention member within the space adjacent the body.

* * * * *